US005354183A

United States Patent [19]

Eisenbacher et al.

[11] Patent Number: 5,354,183

[45] Date of Patent: Oct. 11, 1994

[54] PUMPING DEVICE WITH A MAIN PUMPING STAGE AND A SUPPLY PUMP

[75] Inventors: Egon Eisenbacher, Karlstadt; Franz Pawellek, Marktheidenfeld; Bernhard Arnold, Roden-Ansbach, all of Fed. Rep. of Germany

[73] Assignee: Elasis Sistema Ricerca Fiat Nel Mezzogiorno Societa Consortile per Azioni, Pomigliano d'Arco, Italy

[21] Appl. No.: 16,735

[22] Filed: Feb. 11, 1993

[51] Int. Cl.[5] ..... F04B 39/02

[52] U.S. Cl. ..... 417/366; 417/273

[58] Field of Search ..... 417/273, 366, 368, 307

[56] References Cited

U.S. PATENT DOCUMENTS

| | | | |
|---|---|---|---|
| 1,187,031 | 6/1916 | Black | 417/368 |
| 2,009,881 | 7/1935 | Fourness | 417/307 |
| 2,190,246 | 2/1970 | Schirmer | 417/366 |
| 2,472,355 | 6/1949 | Wittingham | 417/273 |
| 2,605,044 | 7/1952 | Hill | 417/307 |
| 4,681,514 | 7/1987 | Griese et al. | 417/273 |
| 4,865,525 | 9/1989 | Kern | 417/307 |
| 4,952,121 | 8/1990 | De Matthaeis et al. | 417/273 |
| 4,975,025 | 12/1990 | Yamamura et al. | 417/273 |
| 4,990,066 | 2/1991 | Kean | 417/307 |
| 5,152,677 | 10/1992 | Bauer et al. | 417/316 |

FOREIGN PATENT DOCUMENTS 0299337 1/1989 European Pat. Off. .

*Primary Examiner*—Richard A. Bertsch
*Assistant Examiner*—Peter Korytnyk
*Attorney, Agent, or Firm*—Ladas & Parry

[57] ABSTRACT

A pumping apparatus is disclosed comprising a tank containing a fluid to be pumped, a main pumping stage for pumping a controlled amount of said fluid at a predetermined pressure, a supply pump for supplying fluid from said tank to said main pumping stage in excess to said controlled amount, and feedback means for feeding the excess fluid back to said tank along a given drain path; wherein the improvement includes at least part of said drain path running in regions of said main pumping stage subjected to severe thermal and/or mechanical stress.

11 Claims, 2 Drawing Sheets

PUMPING DEVICE WITH A MAIN PUMPING STAGE AND A SUPPLY PUMP

BACKGROUND OF THE INVENTION

The present invention relates to a pumping device comprising a tank containing a fluid to be pumped, a main pumping stage for pumping a controlled amount of said fluid at a predetermined pressure, and a supply pump for supplying fluid from said tank to said main pumping stage in excess to said controlled amount.

Pumping devices of the aforementioned type are employed, for example, when the main pumping stage is in the form of a high-pressure pump. In this case the supply pump provides for ensuring at all times sufficient fluid flow, preferably at a sufficient predetermined pressure, to the intake portion of the high-pressure pump.

A pumping device of the above type is described, for example, in EP-A-0299337, which relates to a pumping device for a motor vehicle fuel injection system. In this case, the supply pump is connected to a parallel pressure relief valve by which any excess fluid is fed directly back to the tank.

Depending on power and output pressure, the main pumping stage is subjected to more or less severe mechanical and/or thermal stress, which, with a main pumping stage output pressure in the order several hundreds bar, may be so severe that steps must be taken for controlling or limiting said stress.

SUMMARY OF THE INVENTION

It is an object of the present invention to provide a pumping device of the aforementioned type, designed to enable straightforward, trouble free control of mechanical and/or thermal stress of the main pumping stage components.

According to the invention, it is now provided a pumping device comprising a tank containing a fluid to be pumped, a main pumping stage for pumping a controlled amount of said fluid at a predetermined pressure, a supply pump for supplying fluid from said tank to said main pumping stage in excess to said controlled amount, and feedback means for feeding the excess fluid back to said tank along a given drain path; wherein the improvement includes at least part of said drain path running in regions of said main pumping stage subjected to severe thermal and/or mechanical stress.

BRIEF DESCRIPTION OF THE DRAWINGS

Non-limiting embodiments of the present invention will be described by way of example, with reference to the accompanying drawings, in which.

DETAILED DESCRIPTION OF THE INVENTION

Figure 1:
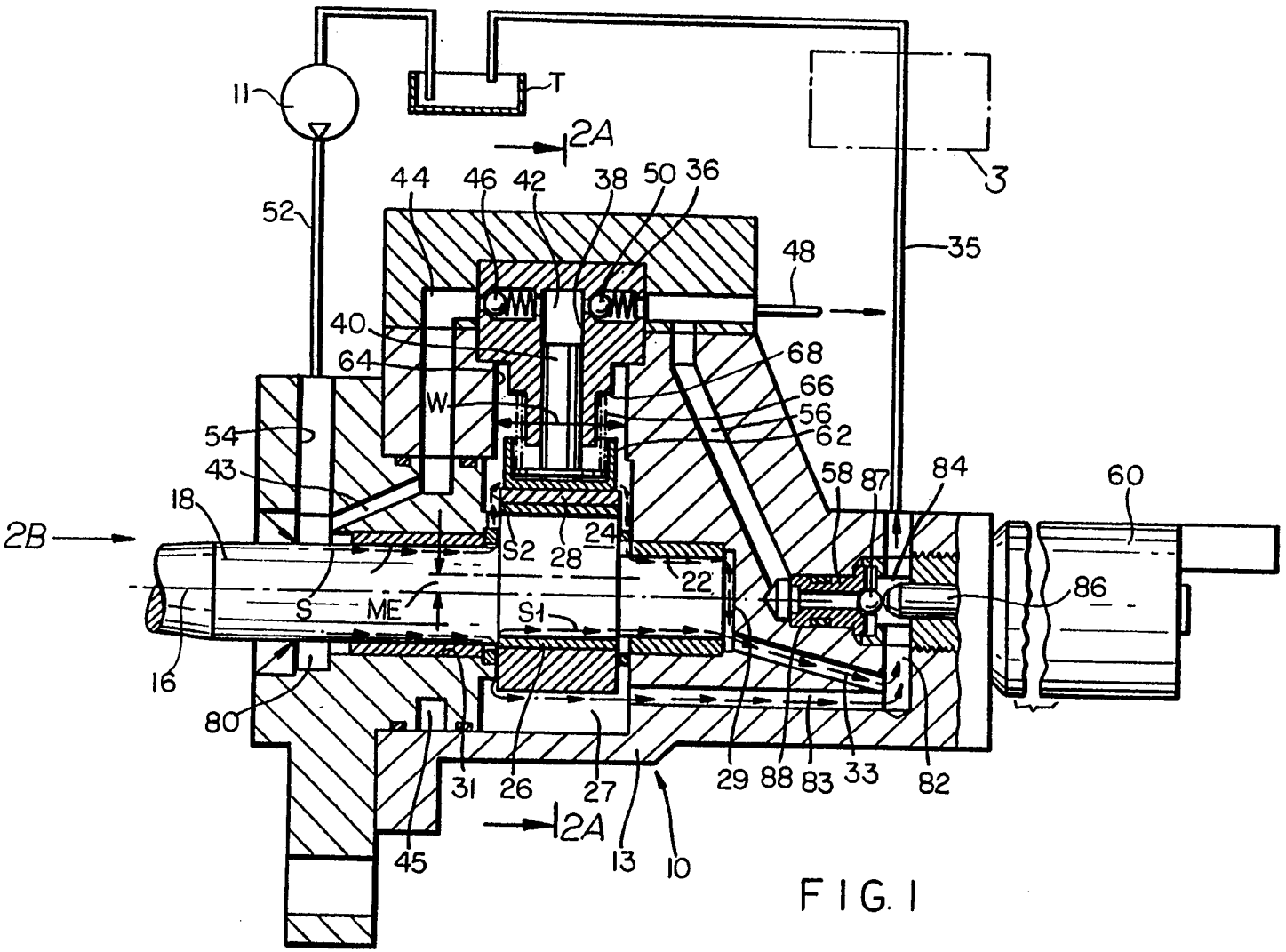
FIG. 1 shows a schematic section of a pumping device according to the invention.

The pumping device in FIG. 1 includes a tank T containing a fluid to be pumped, a main pumping stage 10 consisting, in the embodiment shown, of an eccentric radial-piston pump (high-pressure pump), and a low-pressure pump 11 for supplying the fluid form the tank T to the main pumping stage 10. High-pressure pump 10 includes a hollow body 13 having a pair of opposite sides: in FIG. 1 the input or left side, and the output or right side respectively. The body 13 houses three cylinders 12-1, 12-2, 12-3 (FIG. 2) equally spaced radially at an angular distance of 120°. The mid planes 14 of body 13 diametrical to the three cylinders 12 intersect at axis 16 of a pump shaft 18.

Figure 2A:
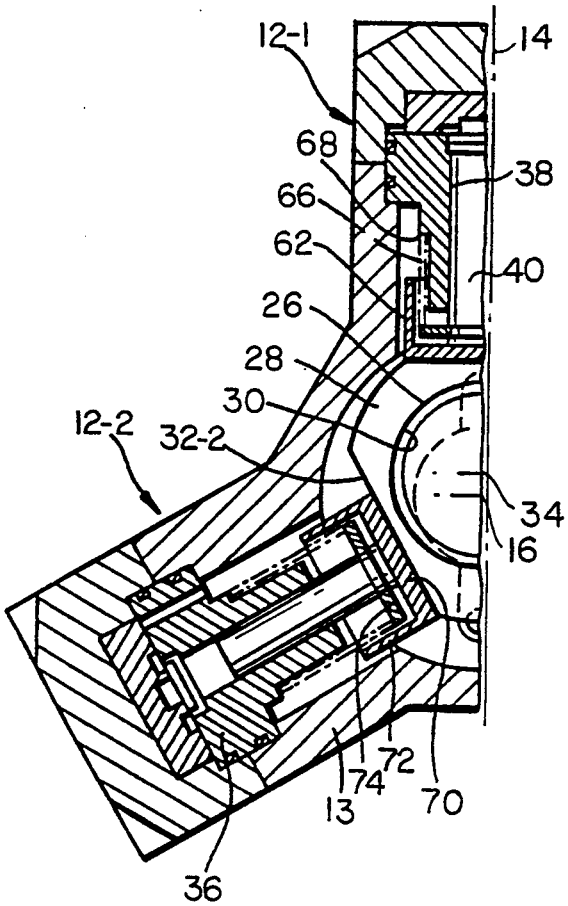
FIG. 2A (left) shows a section taken along line IIA—IIA in FIG. 1.
Figure 2B:
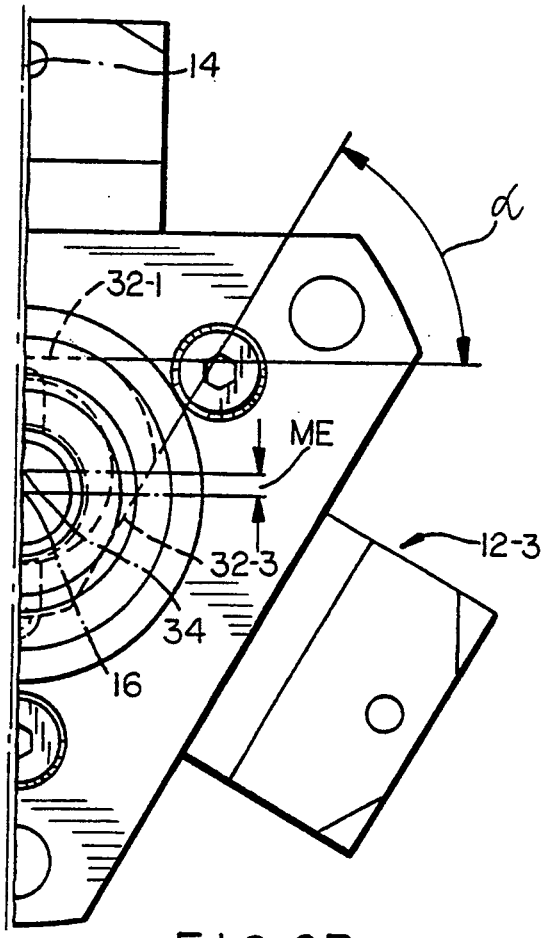
FIG. 2B (right) shows the view IIB of FIG. 1.

The shaft 18 is rotatably mounted in a hole 31 of the body 13 by means of two bearing regions, in the form of sleeve bearings 20 and 22 (FIG. 1). Between the two bearings 20 and 22, the shaft 18 is provided with an eccentric portion 24 formed of a cylinder offset by distance ME in relation to axis 16 of shaft 18. By means of a sleeve bearing 26, eccentric portion 24 is fitted with a rotary eccentric or drive disc 28 provided with a central supporting hole 30 (FIG. 2). The outer peripheral surface of the disk 28 includes three circular portions interspersed with three flats 32-1, 32-2, 32-3. The flats 32 are associated with, and perpendicular to the respective axes of the cylinders 12. Each two adjacent flats 32 define an angle ALPHA of 60°.

Eccentric disk 28 is stabilized, with respect to the body 13, in the angular position shown in the drawings by the pistons 12. When the shaft 18 is rotated, center 34 of the disk 28 rotates with radius ME about axis 16. Flats 32 thus rotate parallel to themselves about a circular path, so as to cyclically reduce or increase the pumping chambers, as described in more detail later on.

Each cylinder 12 includes a recess 64 (FIG. 1), and houses in non-sliding manner an insert 36 having a guide hole 38, which slidably guides a piston 40, in slack free manner. The front face of each piston 40 defines, radially outwards, a variable-volume pumping chamber 42. Each chamber 42 presents a fluid inlet 44 provided with a non-return valve 46, and a fluid outlet 48 also provided with a non-return valve 50.

Inlet 44 is supplied with fluid of the tank T by supply pump 11 along a line 52. A radial channel 54 of the body 13 terminates in a distribution chamber 80 located on the input side of the body 13 and coaxial with axis 16. From chamber 80 an oblique branch channel 43 leads to a further annular chamber 45, from which cylinders 12 are supplied via respective inlets 44.

From distribution chamber 80, there extends a further system of channels, or drain path, described in more detail later on, by which the excess fluid not utilized by the pistons 12 is fed back into tank.To This excess fluid is used for cooling the portions of the main pumping stage 10 subjected to most thermal and/or mechanical stress, e.g. the bearings and supporting surfaces, and some thermally stressed valve bodies.

The drain path along which the excess fluid is drained will now be described in detail with reference to arrows S. The drain path extends initially along shaft 18 and, through bearing 20, to eccentric portion 24 and consequently to bearing 26 of disk 28. At this point, the drain fluid is divided into a flow portion S1 for cooling and lubricating bearing 26, and a flow portion S2 through a chamber 27 formed in the pump housing body 13 and including the recesses 64 for inserts 36.

Accordingly, flow portion S2 flows over the sliding contact surfaces of flats 32 and respective sliding shoes 62 supporting respective pistons 40. Portion S1 flows along shaft 18 to a dead end 29 of supporting hole 31, and from there along a slightly downward-slanting branch line 33 and, through a transverse hole 82 at the output side of body 13, into a catch chamber 84 coaxial with the axis 16. The transverse hole 82 is connected through a feedback line 35 to tank T. From chamber 27, portion S2 flows also along an axial hole 83 also communicating with the transverse hole 82, and from there also into catch chamber 84.

Housed inside a hole 88 at the output side of the body 13, and coaxial with axis 16, is a pressure relief valve 58 connected to pressure outlet 48 by a line 56. Catch chamber 84 surrounds an actuating rod 86 of an electromagnet 60, which rod 86 exerts variable load on the ball 87 of the pressure relief valve 58. Therefore, the path along which the excess fluid from supply pump 11 is drained includes, not only the main pumping stage portions subjected to severe mechanical stress, such as the bearings and sliding surfaces, but also the output region of pressure relief valve 58, so that the heat generated in the valve region may also be conveyed to the tank T by the drain fluid.

In the embodiment of the main stage high-pressure pump 10, the radially inner end of piston 40 rests on a corresponding cup-shaped shoe 62, which slidably contacts the respective flat 32 of eccentric disk 28. Shoe 62 has preferably a cylindrical section, with an outside diameter slightly smaller than the inside diameter W of recess 64 of insert 36.

Shoe 62 includes a circular disk portion 70 and a collar portion 72, the inside diameter of which is slightly larger than the outside diameter of a guide disk 74. This latter is mounted on an annular groove (not shown in detail) on the inner end portion of piston 40, the rest of which is substantially cylindrical. Guide disk 74 is thus mounted in axially-fixed manner on to piston 40, provision should be made for no more than a shallow annular groove, for ensuring the piston 40 is weakened as little as possible.

A return spring 66, shown by the dotted line in the drawings, at one end rests on a shoulder 68 of insert 36, and at the other end rests on the disk 74. This latter acts as a reaction surface for return spring 66 as to load piston 40 radially inwards. In this way, alongside an increase in the volume of the pumping chamber 42, piston 40 follows the radially inward movement of the respective flat 32 of eccentric disk 28. In turn shoe 62 and the respective flat 32 slide transversely in relation to each other. The stabilized flow S, S2 of fluid effectively cools and lubricates also this sliding region so that additional, e.g. hydrostatic, measures for relieving contact in this area are no longer required.

The rotation of eccentric disk 28 causes a reciprocating frictional force Q on the shoe 62, which tends to slide shoe 62 over the surface of flat 32. The guide disk 74 has the function of maintaining shoe 62 in the position shown in the drawings, i.e. axially aligned with the pump pistons 40, throughout the operating cycle of the cylinder/piston assemblies 12/40. In this way the transverse position of the piston 40 is secured, whereby the transverse frictional force Q is radially absorbed via respective piston 40 or the guide 38 in insert 36.

The front radially inner end of piston 40 rests on the inner bottom surface of the disk portion 70 of shoe 62, which is preferably parallel to the outer surface of said disk portion 70, in sliding contact with flat 32 of eccentric disk 28. Piston 40 and shoe 62 may thus be formed separately for eliminating stress in the region of piston 40 and shoe 62, and for better orienting the components by compensating for slack both between them and in relation to the housing body 13. Thus a certain amount of slack may exist between the outer periphery of guide disk 74 and the inner surface of collar portion 72, without negatively affecting stabilization of shoe 62 in relation to the transverse forces Q, to which it is subjected.

The height of collar portion 72 is preferably such that, throughout the stroke of piston 40, which corresponds to twice eccentricity ME, guide disk 74 remains enclosed at all times by collar portion 72. This latter thus prevents any loss of shoe 62 formed separately from piston 40, whereby accidental detachment of shoe 62 is excluded, in the event of piston 40 jamming in guide 38 of insert 36 in the top dead outer position (top of FIG. 1). Due to the portion S2 of the excess fluid from supply pump 11, flowing through chamber 27, the contact surfaces between piston 40 and the bottom of cup-shaped shoe 62 are cooled constantly, thus preventing excessive thermal stress even in the event of micromovements occurring in this region.

Figure 3:
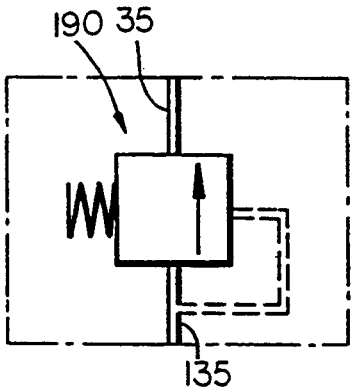
FIG. 3 shows detail III in FIG. 1, according to a modified embodiment.

In the above embodiment, the excess fluid from supply pump 11 is fed directly back to tank T along drain path S, S1, S2, 35. The FIG. 3 detail shows a slightly different embodiment, wherein drain line 35 to the tank T is fitted with a pressure relief valve 190, and wherein the pressure along the drain path may be limited to a few bar upstream from the valve 190.

From the above description it is evident that the pumping device according to the invention provides for feeding the excess fluid to the tank T, along a given drain path running through the regions of the main pumping stage 10 subjected to severe thermal and/or mechanical stress, thus enhancing the load capability of the pumping device, with no more than minor alterations to the device or circuit. The excess fluid from the supply pump 11 may thus be employed for cooling the operating components of the high-pressure pump 10, as well as other parts thereof. In this way, stabilized fluid flow of controlled direction and speed may be achieved through the main pumping stage 10, for eliminating as far as possible any dead spaces which would otherwise be heated.

The present invention is particularly advantageous in the case of pumping devices wherein the main pumping stage 10 is provided with a plurality of radial pistons 40 operated by eccentric cam 28. In this case the cooling fluid from the supply pump 11 is advantageously directed through the housing body 13 along the pump shaft 18. Thus, with a minimum of additional machining in the main pumping stage housing region, all the regions subjected to severe mechanical and thermal stress, such as the bearings 20, 22, 26 and the eccentric mechanism 28, are automatically flushed.

Another advantage lies in the fact that the pressure relief valve 58, normally provided with in the main pumping stage 10, is also reached by the excess fluid fed back to the tank T. Due to the normally high switch pressure of the pressure relief valve 58, the pumping device when operating is connected, is subjected at this point to large quantities of heat, which may effectively be conveyed to the tank T together with the drain fluid. Using the eccentric cam 28 to operate the radial pistons 40, the sliding surfaces of shoes 62 in the main pumping stage 10 are subjected to severe mechanical stress, with no need for additional relief measures. In this way the working life of the main pumping stage is increased and the efficiency and reliability of the main pumping stage may be significantly enhanced with a simple design arrangement.

It is evident that modifications and improvements can be made to the described pumping device, without departing from the scope of the claims. For example, in the above embodiments, supply pump 11 may also be provided with an additional pressure relief valve, the drain line of which supplies line 52. Furthermore, the radial piston pump may be replaced by a different type of high-pressure pump.

We claim:

1. A pumping device comprising:

a tank (T) for containing a fluid to be pumped;

a main pumping stage (10) for pumping a controlled amount of said fluid at a predetermined pressure;

a supply pump (11) for supplying said fluid from said tank (T) to said main pumping stage (10) in excess of said controlled amount;

and feedback means (35) for feeding said excess of said fluid back to said tank (T) from a given drain path (52, 54, S, S1, S2, 33, 82);

wherein at a least part (S, S1, S2, 33, 82) of said drain path (52, 54, S, S1, S2, 33, 82) extends through regions (20, 22, 26–28, 40, 70, 84) of said main pumping stage (10) subjected to at least one of severe thermal and mechanical stress; and wherein said main pumping stage (10) includes a housing body 13, a pump shaft 18), sleeve bearings (20, 22) mounted in said body (13) for rotatably mounting said shaft (18), a plurality of pistons (40) radially arranged in said body (13), and an eccentric cam element (28) mounted on an eccentric bearing (26) of said shaft (18), said cam element (28) including sliding surfaces (32) for operating said radial pistons (40), said part of drain path (S, S1, S2, 33, 82) including said sleeve bearings (20, 22), said eccentric bearing (26) and said sliding surfaces (32).

2. A pumping device according to claim 1, wherein said body (13) includes an input side and an output side, said part of drain path (S, S1, S2, 33, 82) extending from a distribution chamber (80) located at said input side and coaxial with said shaft (18), along said shaft 18), through a chamber (27) of said body (13) housing said sliding surfaces (32), and a hole (31) mounting said shaft (18).

3. A pumping device according to claim 2, wherein said hole (31) includes a dead end (29) connected by a drain hole (33) to a catch chamber (84) located at said output side.

4. A pumping device according to claim 3, including a pressure relief valve (58, 60, 86, 87) provided in said part of said drain path and wherein said pressure relief valve (58, 60, 86, 87) includes an outlet end (86, 87) surrounded by said catch chamber (84).

5. A pumping device according to claim 4, wherein said catch chamber (84) is connected directly to said chamber (27) through a further branch line (83).

6. A pumping device according to claim 5, wherein said cam element includes a circular drive disk (28) mounted for rotation on an eccentric portion (24) of said shaft (18), said sliding surfaces including a plurality of flat portions (32) associated with said pistons (40), said flat portions (32) contacting the respective pistons (40) through respective sliding shoes (62).

7. A pumping device for the fuel supply of an internal combustion motor, comprising a tank (T) containing a fluid to be pumped, a main pumping stage (10) for pumping a controlled amount of said fuel at a high pressure included in the range of 300 to 1600 bar, a supply pump (11) for supplying said fuel from said tank (T) to said main pumping stage (10) in excess to said controlled amount, and feedback means (35) for feeding the excess fluid back to said tank (T) from a given drain path (52, 54, S, S1, S2, 33, 82); wherein said main pumping stage (10) is housed in a hollow body (13) and includes at least a piston (40), a pump shaft (18), sleeve bearings (20, 22) mounted in said body (13) for rotatably mounting said shaft (18), and cam means (28) mounted on said shaft (18) for operating said piston (40) subjected to at least one severe thermal and mechanical stress; wherein the improvement includes at least part (S, S1, S2, 33, 82) of said drain path (52, 54, S, S1, S2, 33, 82) running through said hollow body (13) in regions (20, 22, 26–28, 40, 70, 84) subjected to severe thermal and/or mechanical stress to enable the drain fuel to remove heat therefrom, said part (S, S1, S2, 33, 82) including said sleeve bearings (20, 22) and said cam means (28).

8. A pumping device according to claim 7, including a pressure relief valve (190) incorporated in said feedback means (35) downstream from said body (13).

9. A pumping device according to claim 7, wherein said body (13) includes two opposites sides, said drain path (52, 54, S, S1, S2, 33, 82) including a main line (54, 43, 44, 48,) extending from one of said sides to the other one of said sides, and a branch line (S, S1, S2, 33, 82) running in said regions (20, 22, 26–28, 40, 70, 84).

10. A pumping device according to claim 7, wherein said main pumping stage (10) comprises an electromagnetically controlled pressure relief valve (58, 60, 86, 87) located in said part of drain path (S, S1, S2, 33, 82).

11. A pumping device according to claim 10, wherein said drain path (52, 54, S, S1, S2, 33, 82) extends from a distribution chamber (80) coaxial with said pump shaft (18), along the axis (16) of said pump shaft (18), through a chamber (27) of said hollow body (13) housing said cam means (28), and a dead hole (29) connected by a drain hole 33 to a catch chamber (82, 84) opposite to said distribution chamber (80) on said hollow body (13), the outlet end of said pressure relief valve (58, 60, 86, 87) being surrounded by said catch chamber (84).

* * * * *